US006823686B2

(12) United States Patent
Chumley et al.

(10) Patent No.: US 6,823,686 B2
(45) Date of Patent: Nov. 30, 2004

(54) PRESSURE EQUALIZATION SYSTEM AND METHOD

(75) Inventors: Eugene Chumley, Abingdon, VA (US); Larry G. Pippin, Bristol, VA (US); Pantelis V. Hatzikazakis, Kingsport, TN (US); William Z. Sun, Arkadelphia, AR (US); Timothy M. Wampler, Bluff City, TN (US); Charles E. Zimmerman, Bristol, TN (US); Rongchang Xin, Bristol, VA (US); David T. Monk, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 92 days.

(21) Appl. No.: 10/194,501

(22) Filed: Jul. 12, 2002

(65) Prior Publication Data

US 2002/0178741 A1 Dec. 5, 2002

Related U.S. Application Data

(63) Continuation-in-part of application No. 09/826,106, filed on Apr. 5, 2001, now Pat. No. 6,584,791.

(51) Int. Cl.[7] ..... F25B 41/00; F25B 49/00; F25B 1/00; F25B 1/10; F04B 49/00

(52) U.S. Cl. ..... 62/196.3; 62/228.5; 62/510; 417/299; 417/435; 417/440; 418/201.2

(58) Field of Search ..... 62/196.3, 510, 62/228.5, 498; 417/299, 435, 440; 418/201.2

(56) References Cited

U.S. PATENT DOCUMENTS

| | | | |
|---|---|---|---|
| 3,601,506 A | 8/1971 | Griswold | |
| 3,698,839 A | 10/1972 | Distefano | |
| 4,026,122 A | 5/1977 | Kuhn et al. | |
| 4,270,885 A | 6/1981 | Shaffer et al. | |
| 4,298,314 A | 11/1981 | Thayer | |
| 4,373,870 A | 2/1983 | Pandzik | |
| 4,382,370 A | 5/1983 | Suefuji et al. | |
| 4,470,428 A | 9/1984 | Bishop et al. | |
| 4,593,535 A | 6/1986 | Ikeda et al. | |
| 4,830,582 A | 5/1989 | Asami et al. | |
| 5,141,420 A | 8/1992 | Nambiar | |
| 5,395,214 A | 3/1995 | Kawahara et al. | |
| 5,651,267 A | 7/1997 | Todescat et al. | |
| 5,832,737 A | 11/1998 | Moilanen | |
| 5,911,562 A | 6/1999 | Murphy et al. | |
| 6,293,117 B1 | 9/2001 | Ban et al. | |
| 6,299,423 B1 | 10/2001 | Perevozchhikov | |
| 6,584,791 B2 * | 7/2003 | Monk et al. | 62/196.3 |

FOREIGN PATENT DOCUMENTS

| | | |
|---|---|---|
| DD | 241 454 A1 | 12/1986 |
| EP | 0 743 456 A2 | 11/1996 |
| JP | 2001349627 | 12/2001 |
| WO | WO 94/21919 | 9/1994 |

* cited by examiner

*Primary Examiner*—William Doerrler
*Assistant Examiner*—Filip Zec
(74) *Attorney, Agent, or Firm*—McNees Wallace & Nurick LLC

(57) ABSTRACT

A pressure equalization method and system is provided for starting a compressor while maintaining the condenser at a high pressure and includes a valve and a bleed port. The compressor has a compressor inlet for receiving a fluid at a first pressure and a compressor outlet for discharging the fluid at a second pressure, and is operable to compress the fluid from the first pressure to the second pressure. The valve is proximate to and in fluid communication with the compressor outlet and is movable to an open position when the compressor is operating to permit the fluid at the second pressure to flow through the valve and is movable to a closed position when the compressor stops operating to prevent backflow of the fluid at the second pressure through the valve toward the compressor inlet. The bleed port is upstream of the valve and in fluid communication with the compressor inlet to equalize the pressure of the fluid contained in the compressor when the compressor stops operating.

72 Claims, 12 Drawing Sheets

PRESSURE EQUALIZATION SYSTEM AND METHOD

CROSS-REFERENCE TO RELATED APPLICATIONS

This Application is a continuation-in-part of application Ser. No. 09/826,106, filed Apr. 5, 2001, which issued as U.S. Pat. No. 6,584,791 B2 on Jul. 1, 2003.

BACKGROUND OF THE INVENTION

The present inventiion relates generally to compressors, including those used in refrigeration and HVAC applications. More particularly, the present invention relates to a pressure equalization system and method for starting a compressor, such as scroll, rotary, or reciprocating compressor, while maintaining the condenser at a high pressure.

A standard refrigeration or HVAC system includes a fluid, an evaporator, a compressor, a condenser, and an expansion valve. In a typical refrigeration cycle, the refrigerant fluid begins in a liquid state under low pressure. The evaporator evaporates the low pressure liquid as the liquid absorbs heat from the evaporator, which raises the ambient temperature of the liquid and causes the liquid to undergo a phase change to a low pressure gas. The compressor draws the gas in and compresses it, producing a high pressure gas. The compressor then passes the high pressure gas to the condenser. The condenser condenses the high pressure gas to release heat to the condenser and undergo a phase change to a high pressure liquid. The cycle is completed when the expansion valve expands the high pressure liquid, resulting in a low pressure liquid. By means of example only, the refrigerant fluid used in the system might be ammonia, ethyl chloride, CFCs, HFCs, Freon®, or other known refrigerants.

Typically, upon start up of a compressor, the pressure at both the suction port and the discharge port of the compressor is low. In operation, the compressor works the fluid to achieve a high pressure at the discharge port. However, when the compressor is no longer operating, the fluid on the high pressure side of the compressor (toward the condenser) flows back toward the low pressure side of the compressor (toward the evaporator) until a state of equilibrium between the formerly high and formerly low pressure sides is achieved. Thus, the pressure tends to equalize between the low pressure side and the high pressure side when the compressor stops operating. Such a system is inefficient because the refrigeration cycle requires energy at start up to create a high pressure in the condenser, which is needed to condense the fluid.

Another problem, specific to HVAC systems, is that it is difficult to efficiently achieve the high pressure start up, i.e. a start up where the pressures have not equalized, necessitated by seasonal energy efficiency requirements (SEER), a system used to rate HVAC systems. Start up components, such as a start capacitor and a start relay, are commonly used to overcome the differential pressure when the compressor needs to start with the unbalanced pressure in the system, i.e. the high pressure side of the system has a high pressure and the low pressure side of the system has a low pressure. These components achieve a high pressure differential start when the system is turned on. These components are rather expensive, however, and they produce high voltages and currents in the compressor motor upon start up.

Therefore what is needed is a system and method for equalizing the pressure in the compressor in order to start the compressor while maintaining a high pressure in the condenser and the high pressure portion of the system.

SUMMARY OF THE INVENTION

As explained in more detail below, the system and method of the present invention maintain a high pressure from a valve near the compressor discharge downstream to a condenser, but permit the pressure upstream of the valve to leak back toward the compressor suction until the pressure upstream of the valve has equalized with the low pressure side of the compressor. By high loading the pressure downstream from the valve and equalizing the pressure upstream from the valve, expensive and potentially dangerous start up components are eliminated. A benefit specific to HVAC systems is that the SEER rating of the system is not sacrificed.

The present invention is directed to a pressure equalization system for a compressor. The compressor has a compressor inlet for receiving a fluid at a first pressure from the evaporator and a compressor outlet for discharging the fluid at a second pressure to the condenser. The compressor is operable to compress the fluid from the first pressure to the second pressure. The system of the present invention includes a valve proximate to and in fluid communication with the compressor outlet and a bleed port upstream of the valve and in relatively low flow fluid communication with the compressor inlet. The valve has an open and a closed position. The valve is movable to the open position when the compressor is operating, to permit the fluid at the second pressure to flow through the valve. The valve is movable to the closed position when the compressor stops operating, to prevent backflow of the fluid at the second pressure through the valve toward the compressor inlet. The bleed port equalizes the pressure of the fluid contained in the compressor when the compressor stops operating.

In another embodiment, the present invention is directed to a pressure equalization system for a compressor having a high pressure side and a low pressure side, a compressor inlet for receiving a fluid at a first pressure, and a compressor outlet for discharging the fluid at a second pressure. The compressor is operable to compress the fluid from the first pressure to the second pressure. The system in this embodiment includes a container in fluid communication with the compressor, at least one valve operably disposed within the container, and a bleed port. The container has an inlet and an outlet, and either the inlet or the outlet of the container is connected to the outlet of the compressor. The container is divided into at least a first portion from the container inlet to the at least one valve and a second portion from the at least one valve to the container outlet. The valve is operably configured to permit the compressed fluid to flow through to the second portion of the container when the compressor is operating, and to prevent the compressed fluid in the second portion of the container from flowing back through the valve to the first portion of the container when the compressor stops operating. The bleed port connects the first portion of the container and the low pressure side of the compressor and is operably configured to bleed the compressed fluid from the first portion of the container to the low pressure side of the compressor when the compressor stops operating. The bleed port is further configured so that when the compressor is operating, the flow through the bleed port is relatively low, if not nonexistent. As a result, a negligible amount of fluid flows back to the compressor inlet, i.e. the low pressure side, when the compressor is operating.

Still another embodiment of the present invention is directed to a system to equalize fluid pressure between a first portion of a compressor at a first pressure and a second portion of the compressor at a second pressure greater than the first pressure upon the compressor not being in operation. The system includes a housing having a first and a second inlet for fluid and a first and a second outlet for fluid. The first and second inlets for a fluid are in fluid communication with the second portion of the compressor. The first outlet for a fluid is configured to permit flow of fluid from the system and the second outlet for a fluid is in fluid communication with the first portion of the compressor. The system further includes a chamber disposed within the housing. The chamber is in fluid communication with the first inlet, the second inlet, the first outlet and the second outlet. A piston is slidably disposed within the chamber between a first position and a second position, wherein the first inlet and the first outlet are in fluid communication upon the piston being in the first position and the second inlet and the second outlet are in fluid communication upon the piston being in the second position. The system also includes means for sliding the piston in the chamber between the first position and the second position. Finally, the means for sliding the piston in the chamber positions the piston in the second position upon the compressor not being in operation, thereby permitting fluid at a second pressure to flow through the second outlet to the first portion of the compressor to equalize pressure in the compressor.

A further embodiment of the present invention is directed to a system to equalize pressure between a first portion of a compressor at a first pressure and a second portion of the compressor at a second pressure greater than the first pressure upon the compressor not being in operation. The system includes a housing having at least one inlet for a fluid and first and second outlets for a fluid. The at least one inlet for a fluid is in fluid communication with the second portion of the compressor. The first outlet for a fluid is configured to permit flow of fluid from the system. The second outlet for a fluid is in fluid communication with the first portion of the compressor. The system further includes a chamber disposed within the housing being in fluid communication with the at least one inlet, the first outlet and the second outlet. The system also includes means for providing a fluid passageway from the at least one inlet to the first outlet upon the compressor being in operation and means for providing a fluid passageway from the at least one inlet to the second outlet upon the compressor not being in operation to permit a fluid at a second pressure to flow through the second outlet to the first portion of the compressor to equalize pressure in the compressor. The means for providing a fluid passageway from the at least one inlet to the first outlet comprising means for preventing fluid from entering the second outlet and the means for providing a fluid passageway from the at least one inlet to the second outlet comprising means for preventing fluid from entering the first outlet.

Yet another embodiment of the present invention is directed to a system to equalize pressure between a first portion of a compressor at a first pressure and a second portion of the compressor at a second pressure greater than the first pressure when the compressor is not in operation. The system includes a valve and a bleed port upstream of the valve. The valve is in fluid connection with the second portion of the compressor and has an open position permitting flow of fluid from the system upon the compressor being in operation and a closed position preventing flow of fluid through the valve upon the compressor not being in operation. The bleed port is in fluid communication with the second portion of the compressor and has a relief valve controlled by an operational feature of the compressor. The relief valve is in an open position upon the compressor not being in operation to permit flow of fluid through the bleed port to the first portion of the compressor to equalize pressure in the compressor, and the relief valve is in a closed position upon the compressor being in operation to prevent flow of fluid through the bleed port to the first portion of the compressor.

Other features and advantages of the present invention will be apparent from the following more detailed description of the preferred embodiment, taken in conjunction with the accompanying drawings which illustrate, by way of example, the principles of the invention.

DESCRIPTION OF THE DRAWINGS

The accompanying drawings, which are incorporated in and constitute a part of this specification, illustrate several embodiments of the invention. Together with the description, these drawings serve to explain the principles of the invention.

Wherever possible, the same reference numbers will be used throughout the drawings to refer to the same or like parts.

DETAILED DESCRIPTION OF THE INVENTION

A method and a system for equalizing the pressure in a compressor is provided to permit a startup of the compressor while maintaining a high pressure in portions of the system. It is contemplated that the compressor may be a component of a climate control system, including a refrigeration, freezer, or HVAC system. However, its use is not limited to such systems as the pressure equalization system may be used in any system utilizing a compressor.

Figure 1:
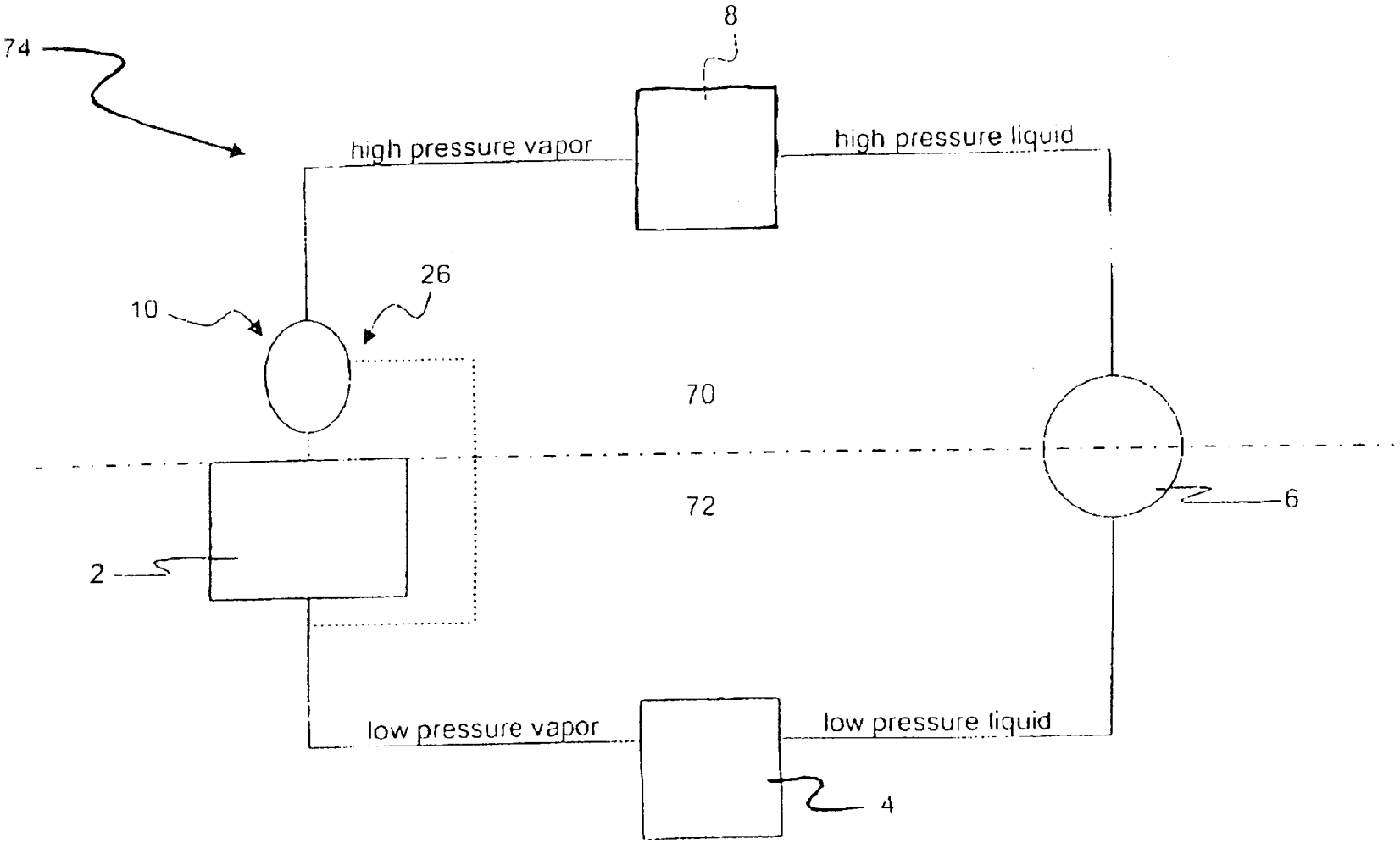
FIG. 1 is a block diagram of a climate control system schematically illustrating a pressure equalization system and method in accordance with the present invention.

An exemplary embodiment of a refrigeration system, including a compressor with a pressure equalization system according to the present invention, is illustrated in FIG. 1 and is designated generally as reference number 74.

In a refrigeration or HVAC system 74, typically a fluid or refrigerant flows through the system and heat is transferred from and to the fluid. When refrigeration system 74 is turned on, fluid in a liquid state under low pressure is evaporated in an evaporator 4 as the fluid absorbs heat from the evaporator, which raises the ambient temperature of the fluid and results in fluid in a low pressure vapor state. A compressor 2 draws away fluid at a low pressure vapor state and compresses it. Then, fluid at a high pressure vapor state flows to a condenser 8. Condenser 8 condenses the fluid from a high pressure vapor state to a high pressure liquid state. The cycle is completed when an expansion valve 6 expands the fluid from a high pressure liquid state to a low pressure liquid state. The fluid is any available refrigerant, such as, for example, ammonia, ethyl chloride, Freon®, chlorofluocarbons, hydrofluorocarbons, and natural refrigerants.

In conventional systems, when refrigeration system 74 stops operating, the fluid on the high side of compressor 2 at a high pressure vapor state will leak back toward the evaporator 4, and eventually the pressure of the fluid in the compressor 2 will reach a state of equilibrium. When the refrigeration system 74 is placed back into operation, the pressure at the condenser 8 must be brought back up to the pressures prior to refrigeration system 74 shutting down. In high efficiency systems, start capacitors and start relays are used to restart the compressor 2 and achieve this result when the pressures in the compressor are not equal. These components are expensive and produce high voltages and currents in the compressor 2 upon start up. Pressure equalization system 10 overcomes the need for such components in high efficiency systems and the problems and expenses associated with conventional systems, as described in more detail below.

Figure 2:
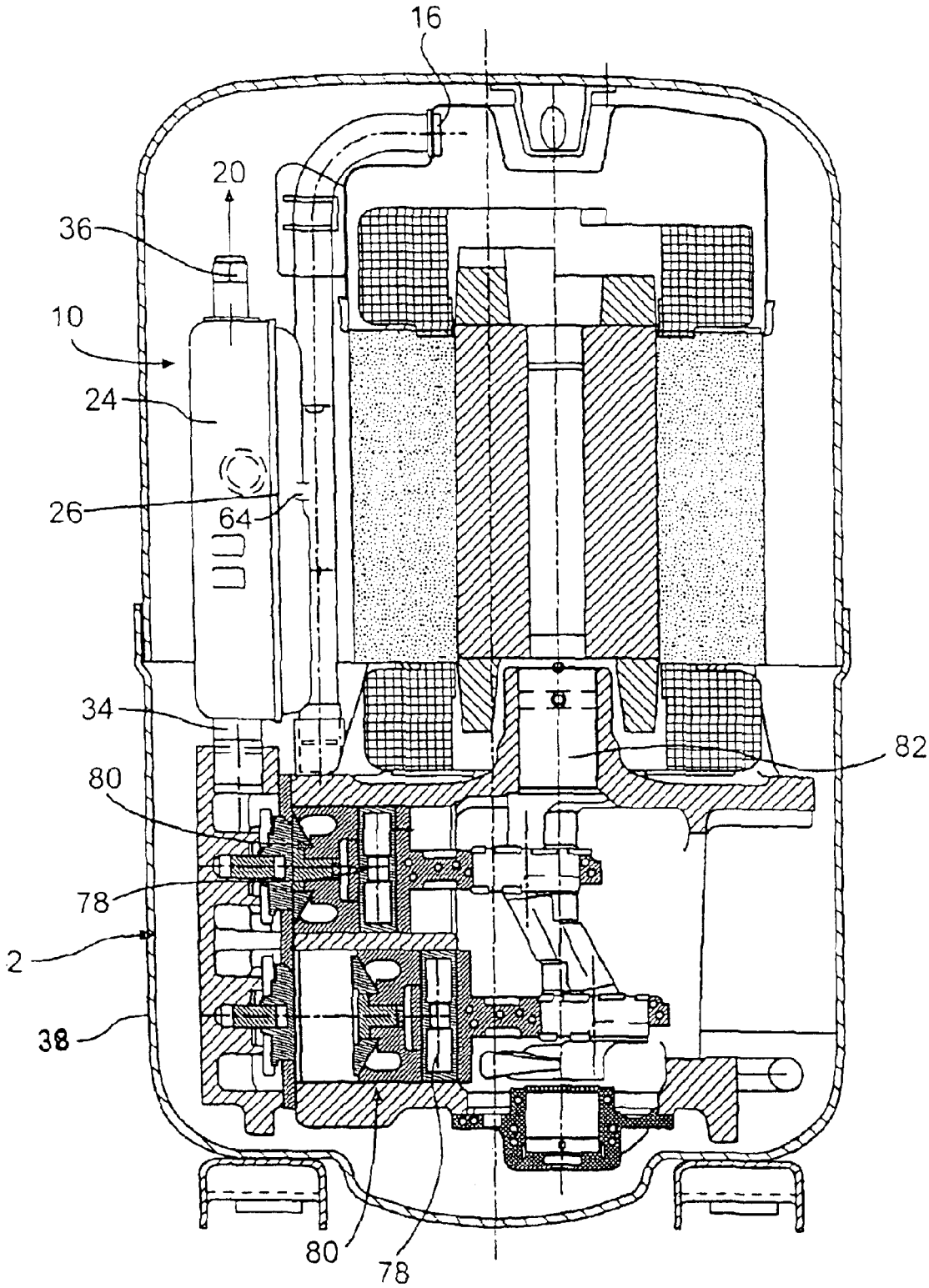
FIG. 2 is a cross-sectional view of a compressor including an internal pressure equalization system in accordance with an embodiment of the present invention.
Figure 3:
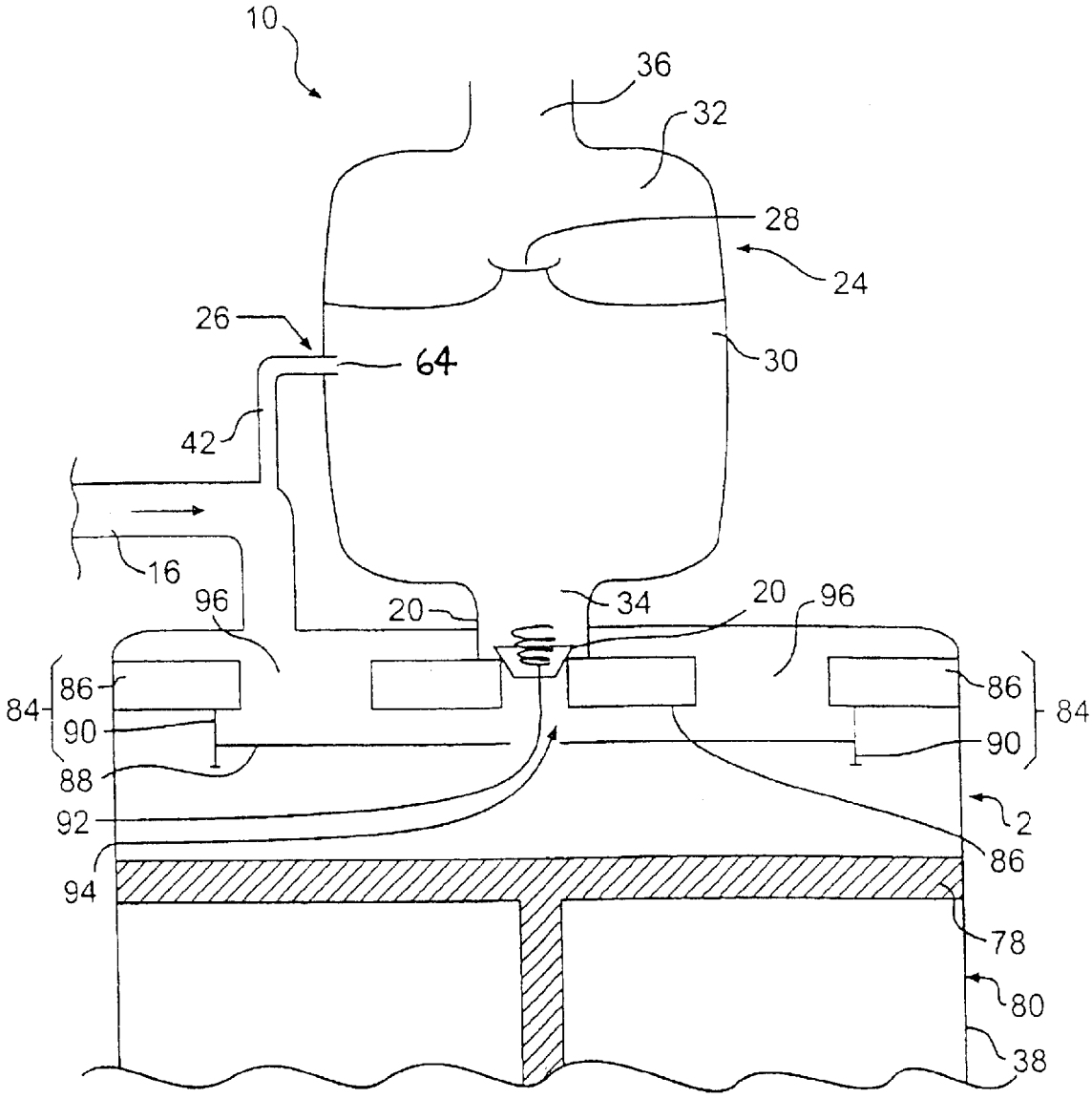
FIG. 3 is a cross-sectional view of a pressure equalization system attached externally to a compressor in accordance with another embodiment of the present invention.

The general components of a reciprocating compressor 2 are illustrated in FIGS. 2 and 3. The components may include compressor housing 38 that houses a shaft 82 that rotates and causes one or more pistons 78 to move within one or more compression chambers 80. The fluid, described above with respect to the schematic in FIG. 1, is drawn at a low pressure into a compressor inlet 16 (or suction line) and into compression chamber 80. For the purposes of the present invention, the compressor inlet 16 can be any point in the fluid flow channel extending from the evaporator 4 to the compression chambers 80. Piston 78 is operable to move within compression chamber 80 to compress the fluid, which exits compressor 2 at a high pressure through a compressor outlet 20 (or discharge). For the purposes of the present invention, the compressor outlet 20 can be any point in the fluid flow channel downstream from the compression chamber 80 to the condenser 8.

A compressor typically includes a valve system 84, such as the system exemplified in FIG. 3, to prevent the fluid from flowing back toward compressor inlet 16 when the compressor is operating. Such systems are known to those skilled in the art, and the system depicted in FIG. 3 is illustrative only and in no way limits the claimed invention. The illustrated valve system 84 includes a valve plate 86 disposed within compressor housing 38, a valve 92 operably disposed at the compressor outlet 20, and a ring valve 88, defining an aperture 94, slidably disposed on holders 90. Retraction of piston 78 creates a vacuum that draws ring valve 88 away from gaps 96, and draws the fluid into compression chamber 80 through compressor inlet 16. A valve 92 on compressor outlet 20 prevents the fluid from exiting compressor 2 until the fluid reaches a pressure exceeding that beyond valve 92. When piston 78 moves and compresses the fluid to this pressure, the force of the fluid opens valve 92, thereby permitting the high pressure fluid to discharge through compressor outlet 20. During the compression stroke, the force of the fluid moves ring valve 88 towards valve plate 86, blocking gaps 96 and preventing the fluid from escaping through compressor inlet 16.

In accordance with the present invention, a pressure equalization system and method is provided to equalize the pressure in the compressor 2, permitting the compressor 2 to start under non-high pressure loading, while maintaining a high pressure in the high pressure portion of the refrigeration system 74. In one embodiment, the pressure equalization system is connected to the compressor 2 and has a valve or a series of valves and a bleed port. The valve or valves maintain high pressure on the high pressure portion of the refrigeration system 74, i.e. the valve(s) maintains a high pressure downstream from the valve to the condenser 8 and the expansion valve 6, when the refrigeration system 74 stops operating. The bleed port permits the pressure in the compressor 2 to reach a state of equilibrium between the high pressure side and the low side of the compressor 2 when the refrigeration system 74 is turned off. The bleed port is configured to permit little to no fluid to pass through when the system 74 is operating but to permit fluid to leak through when the system is turned off. The pressure equalization system maintains fluid at a high pressure vapor state on the high pressure portion of the refrigeration system 74 while permitting fluid in the compressor 2 to reach a state of equilibrium when the compressor 2 and refrigeration system 74 are turned off. Upon restarting the compressor 2 and refrigeration system 74, it is therefore easier and more efficient to achieve the high pressure state in the high pressure portion of the system 74 because most of the high pressure portion of the system 74 has maintained a high pressure state and has not equalized with the low pressure portion of the system.

Exemplary embodiments of a compressor with a pressure equalization system are illustrated in FIGS. 2 and 3. It is contemplated that pressure equalization system 10 may be located internally within compressor 2, as shown in FIG. 2, or externally as shown in FIGS. 1 and 3. The compressor 2 shown in FIG. 2 is a reciprocating compressor, although the pressure equalization system 10 may be used with any compressor, including, for example, a rotary, screw, or scroll compressor.

As illustrated in FIGS. 2 and 3, compressor outlet 20 is in communication with a housing 24 of pressure equalization system 10, which has a housing inlet 34 and a housing outlet 36. In FIG. 2, housing 24 is located internally within compressor 2, and housing outlet 36 connects to compressor outlet 20. The present invention contemplates, however, that housing 24 in FIG. 3 may be positioned externally to compressor 2, such that housing inlet 34 connects to compressor outlet 20. Among other variations, it also has been contemplated that housing inlet 34 could be connected to a cylinder head and housing outlet 36 could be connected to compressor outlet 20.

In the embodiments shown in FIGS. 2 and 3, housing 24 is a container or a muffler. Housing 24 also could be a cylinder or any other closed chamber, as described in more detail with respect to FIGS. 8–10. Whether housing 24 is internal or external to compressor 2, the pressure equalization system 10 maintains the fluid at a high pressure vapor state on the high pressure side towards housing outlet 36 while permitting the fluid towards compressor inlet 16 to equalize with the fluid at a low pressure vapor state.

Various embodiments of pressure equalization system 10 are depicted in FIGS. 4–10. In each of these embodiments, it is assumed that housing 24 is in communication with compressor 2 as previously described.

Figure 4:
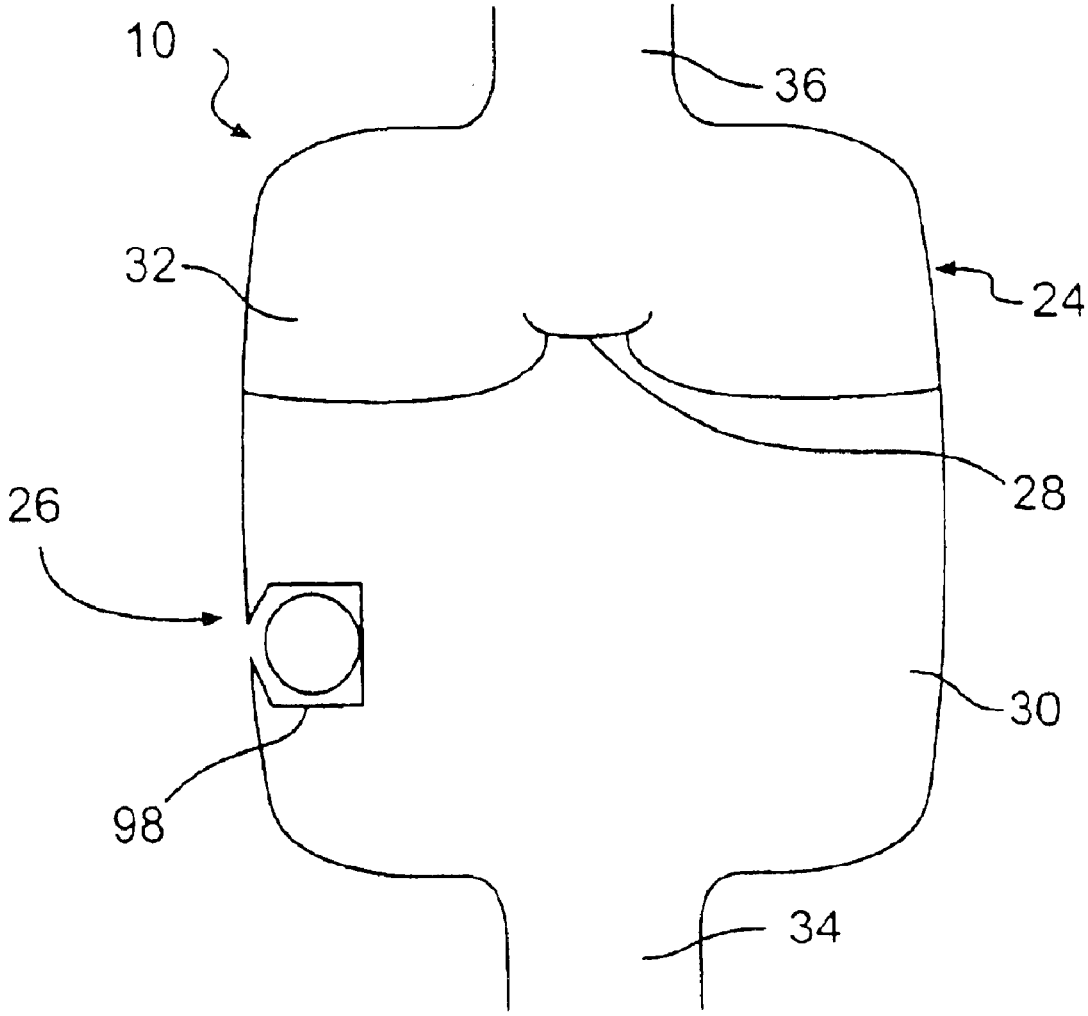
FIG. 4 is a cross-sectional view of a pressure equalization system, including a housing, two valves, and a bleed port, in accordance with an embodiment of the present invention.

In a basic embodiment of pressure equalization system 10, shown in FIG. 4, housing 24 has a bleed port 26 and at least one valve 28. Valve 28 divides housing 24 into a first portion 30 and a second portion 32. First portion 30 of housing 24 occupies a space between housing inlet 34 and valve 28, while second portion 32 of housing 24 occupies a space between valve 28 and housing outlet 36. Valve 28 is operably disposed in housing 24 and may be opened or closed. When compressor 2 is on, valve 28 is open and permits the fluid compressed at a high pressure vapor state to flow from first portion 30 of housing 24 to second portion 32 of housing 34. When compressor 2 stops operating, valve 28 closes, preventing backflow of the fluid at a high pressure vapor state into first portion of housing 24. Bleed port 26, located in first portion 30 of housing 24, connects first portion 30 of housing 24 to low pressure side 72 of compressor 2, such as to compressor inlet 16, permitting the pressure of the fluid, which is at a high pressure vapor state when the compressor 2 initially is turned off, to equilibrate with the fluid on the low side of compressor 2, which is at a low pressure vapor state. Bleed port 26 is connected to a low pressure side of compressor 2 in a sealed manner, for example, through a pipe, tube, or other flow channel, so that the fluid stays within the system 74 and does not leak into the atmosphere.

Figure 11:
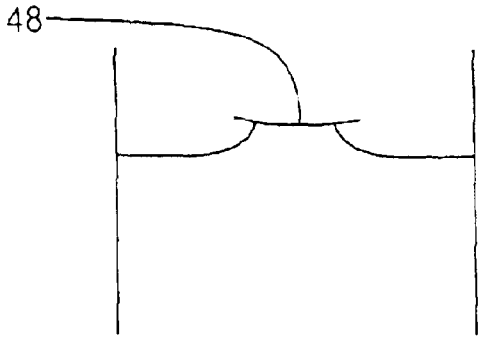
FIG. 11 is a cross sectional view of a magnetic check valve in accordance with an embodiment of the present invention.
Figure 12:
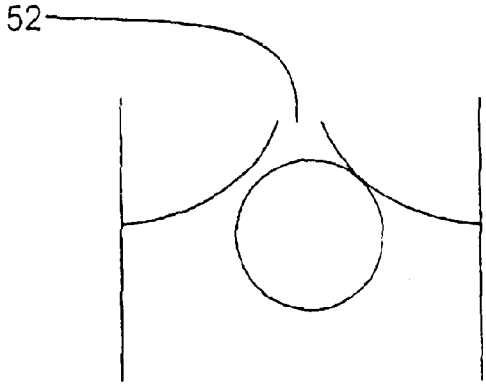
FIG. 12 is a cross sectional view of a ball check valve in accordance with another embodiment of the present invention.
Figure 13:
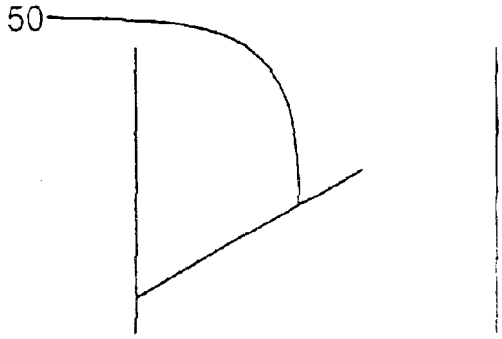
FIG. 13 is a cross sectional view of a flapper check valve in accordance with another embodiment of the present invention.

It is contemplated that valve 28 of pressure equalization system 10 may be one or more of a variety of valve types. Some typical valves are illustrated in FIGS. 11–13. One embodiment, illustrated in FIG. 11, is a magnetic check valve 48. Another embodiment, illustrated in FIG. 12, is a ball check valve 52. Yet another embodiment, illustrated in FIG. 13, is a flapper check valve 50. Any type of one-way valve, including but not limited to these valves, can be applied to the present invention.

Figure 8:
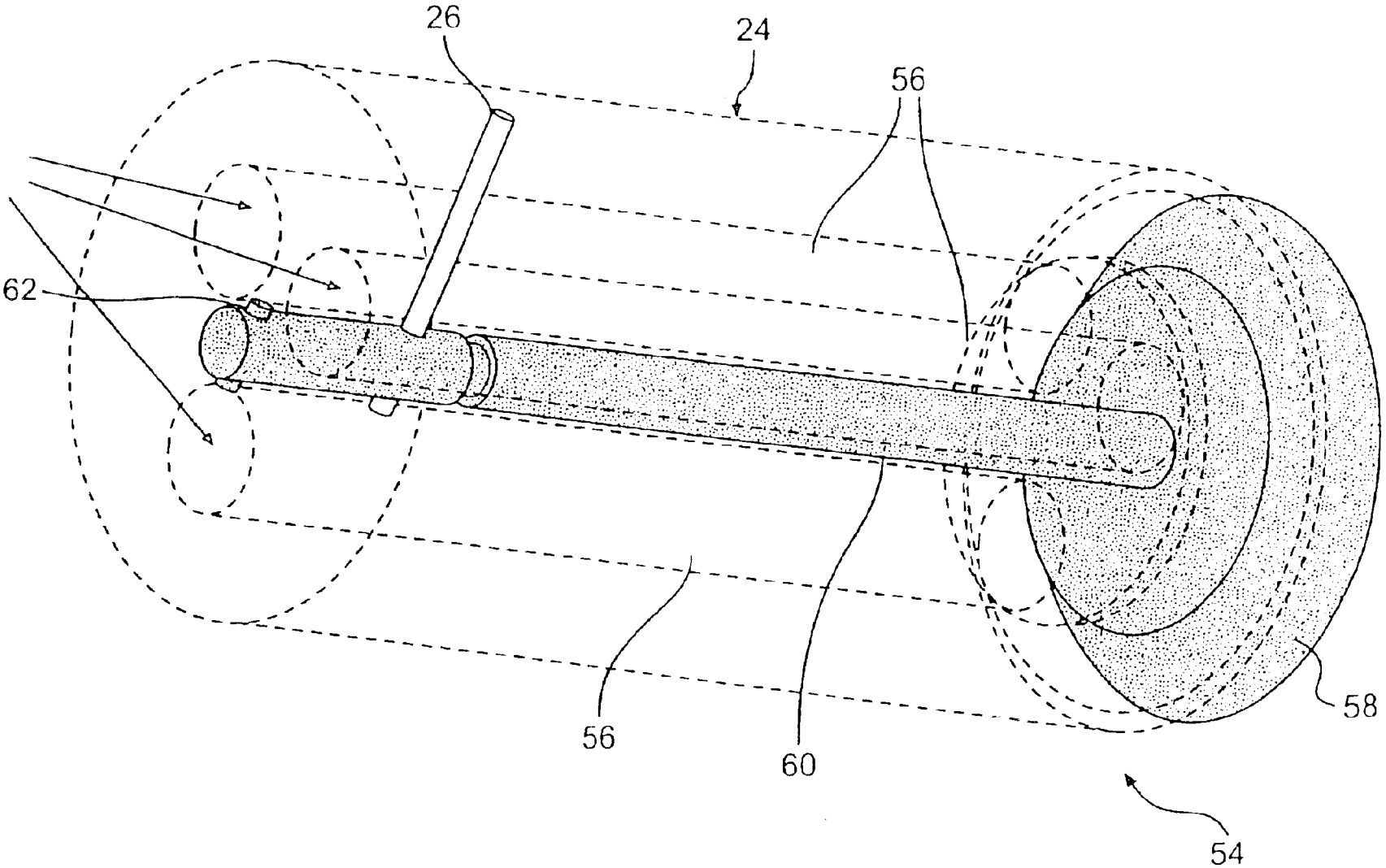
FIG. 8 is a perspective view of a cylinder valve in accordance with an embodiment of the present invention.
Figure 9:
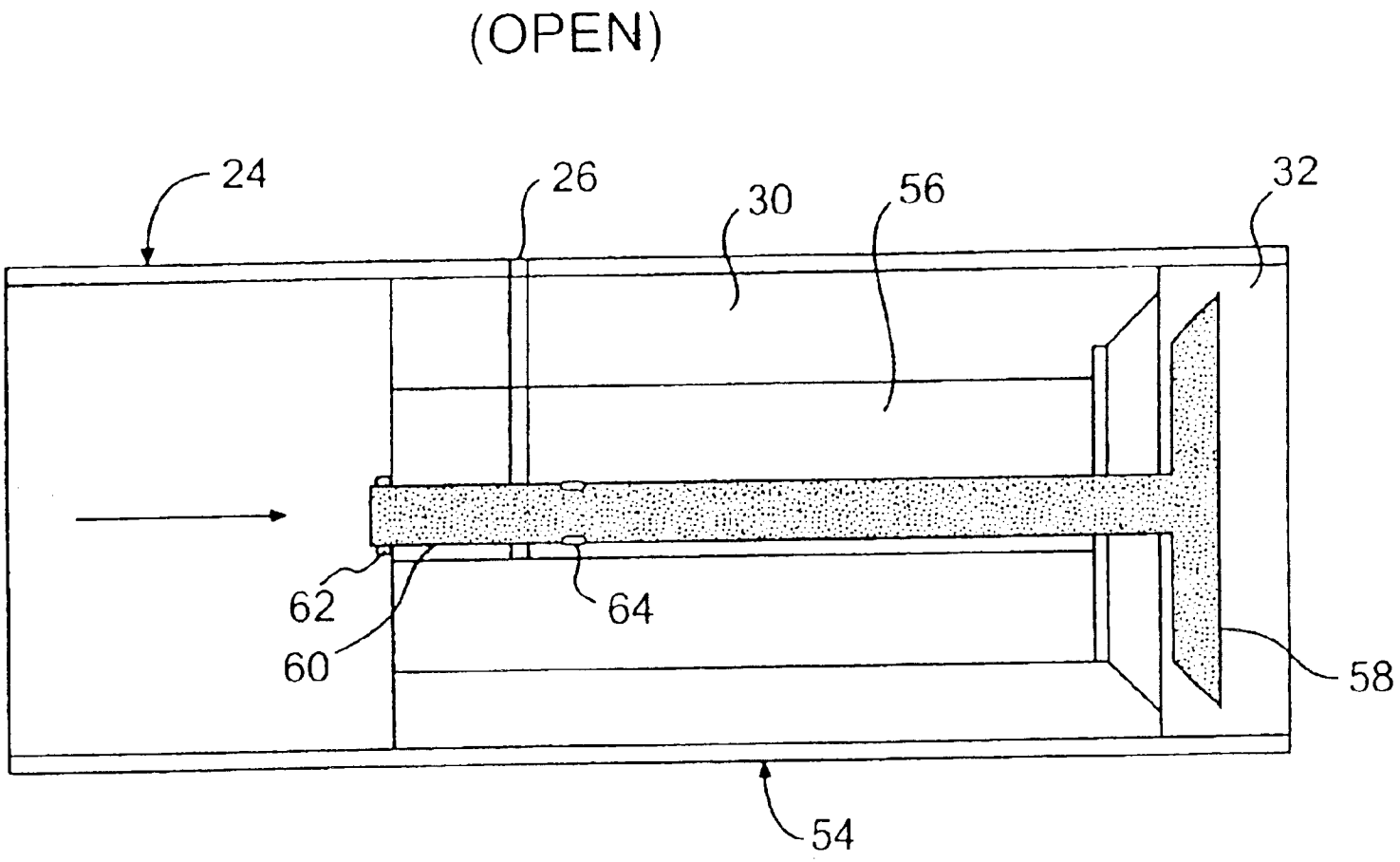
FIG. 9 is a section through the piece of the cylinder valve depicted in FIG. 8 in an open position.
Figure 10:
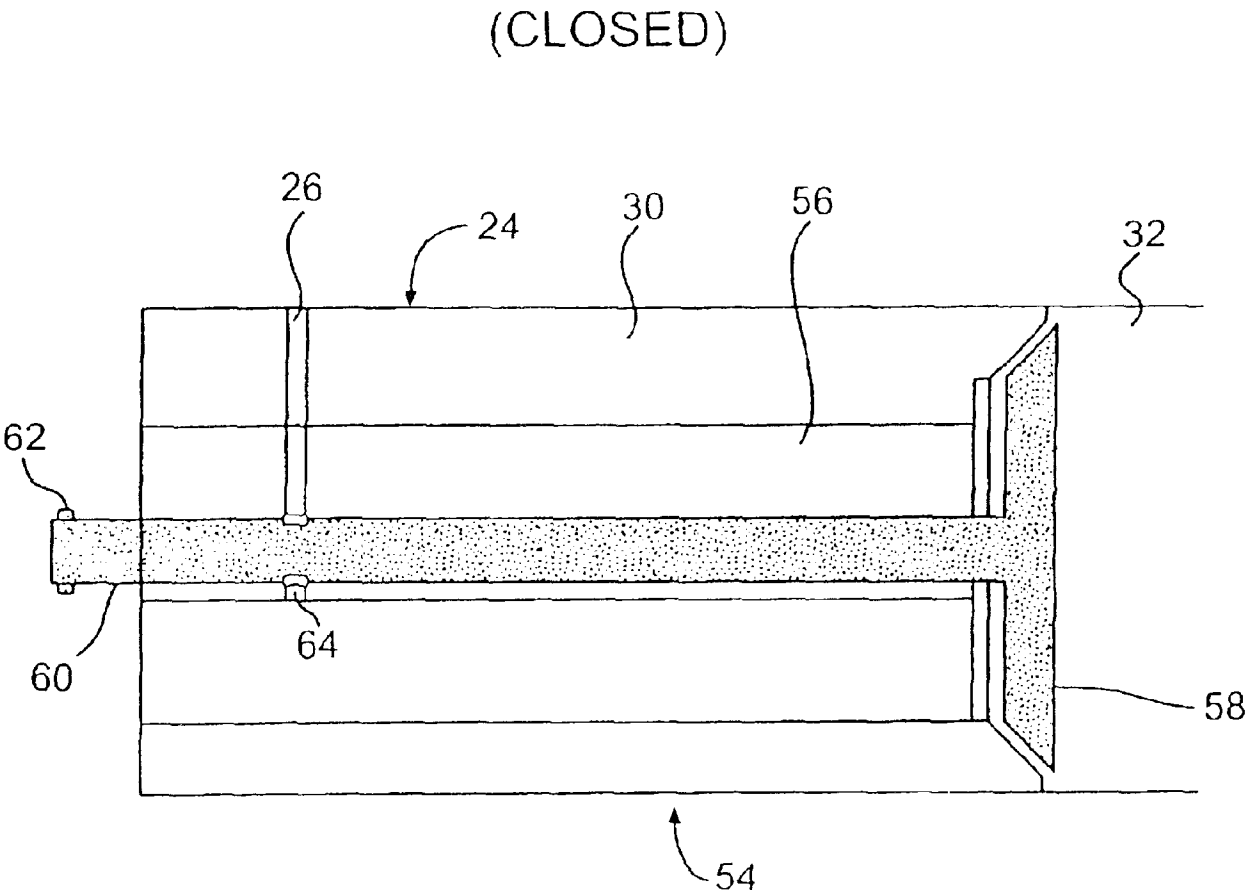
FIG. 10 is a section through the piece of the cylinder valve depicted in FIG. 8 in a closed position.

In an embodiment illustrated in FIGS. 8–10, pressure equalization system 10 comprises housing 24 having a cylinder check valve 54, and preferably bleed port 26 is of an aperture 64 type. In such an embodiment, housing 24 defines a cylinder that includes a plurality of channels 56 for conducting the fluid. It is contemplated, however, that cylindrical housing 24 may have as few as one channel 56. First portion 30 of cylindrical housing 24 is substantially solid aside from channels 56, while second portion 32 of cylindrical housing 24 is open. Valve 54 disposed within cylindrical housing 24 has a valve stem 60 attached to an end portion such as a poppet 58.

Poppet 58 is located in second portion 32 of housing 24. It is contemplated that poppet 58 has a cross-sectional area equal to the internal area of cylindrical housing 24, although any configuration of housing 24 and poppet 58 that prohibits the fluid from leaking from first portion 30 of housing 24, through valve 54, to housing outlet 36, is acceptable.

Meanwhile, valve stem 60 extends from poppet 58 through first portion 30 of housing 24 and towards inlet 34 of housing 24. Valve stem 60 may have an overtravel stopper 62 beyond inlet 34 of housing 24 that comes in contact with the substantially solid first portion 30 of housing 24 when compressor 2 is operating. Although overtravel stopper 62 is shown in the embodiment illustrated in FIGS. 8–10, any device that prevents poppet 58 and valve stem 60 from being pushed through housing 24 by the fluid is acceptable.

When compressor 2 is operating, the fluid at a high pressure vapor state travels into inlet 34 (not shown in FIGS. 8–10) of housing 24 and into channels 56, forcing cylinder valve 54 to open. As shown in FIG. 9, because the fluid forces poppet 58 into second portion 32 of housing 24, the fluid passes through the opening created when poppet 58 is forced open and toward housing outlet 36. Overtravel stopper 62 prevents poppet 58 and valve stem 60 from being forced too far into or beyond second portion 32 of housing 24. As shown in FIG. 10, when compressor 2 stops operating, the fluid stops flowing into housing inlet 34 and into channels 56, and as a result poppet 58 is no longer forced open by the fluid. Poppet 58 therefore closes, preventing the fluid contained in second portion 32 of housing 24 from flowing back towards housing inlet 34. The fluid in the second portion 32 of housing 24 on high pressure side 70 of compressor 2 therefore remains at a high pressure vapor state, thus high pressure side 70 of refrigeration system 74 remains high.

A bleed port 26 is provided to equalize pressure upon startup of a compressor 2. In an embodiment shown in FIGS. 8–10, when compressor 2 stops operating, the high pressure vapor state fluid in channels 56 in first portion 30 of housing 24 is permitted to equalize with the fluid at a low pressure vapor state, thus the first portion 30 of housing 24 on the high pressure side 70 of compressor 2 is at a lower pressure, resulting in the aforementioned benefits upon restarting compressor 2. The equilibration in this preferred embodiment is due to bleed port 26, as shown in FIGS. 8–10 and described more fully below.

It is also contemplated that bleed port 26 of pressure equalization system 10 includes a variety of forms, provided bleed port 26 permits the fluid contained in first portion 30 of housing 24 at a high pressure vapor state to equalize with the fluid at a low pressure vapor state on low pressure side 72 of compressor 2. Additionally, bleed port 26 is configured so that little to no fluid leaks through to low pressure side 72 of compressor 2 when the refrigeration system 74 is operating but permits fluid to leak through to low pressure side 72 of compressor 2 when the refrigeration system 74 is shut down.

For example, bleed port 26 may be a simple aperture or hole in first portion 30 of housing 24. As illustrated in FIG. 2, when housing 24 is located internally within compressor 2, bleed port 26 may be a hole or aperture 64 between housing 24 and compressor inlet 16. In this embodiment, bleed port 26 is small enough to prevent a significant amount of fluid from flowing back to compressor inlet 16 when the compressor is operating, but large enough to permit the pressure of the fluid to reach a state of equilibrium with low pressure side 72 of compressor 2 over a period of time when the compressor stops operating.

Meanwhile, when housing 24 is external to compressor 2, as shown in FIG. 3, a connector 42, such as a capillary or other tube or hypodermic needle, connects first portion 30 of housing 24 to low pressure side 72 of compressor 2, such as to compressor inlet 16, in order to equalize fluid pressure. Again, bleed port 26, including aperture 64 leading to connector 42, is small enough to prevent a significant amount of fluid from flowing back to compressor inlet 16 when the compressor is operating, but large enough to permit the pressure of the fluid to reach a state of equilibrium with low pressure side 72 of compressor 2 over a period of time when the compressor stops operating.

Figure 6:
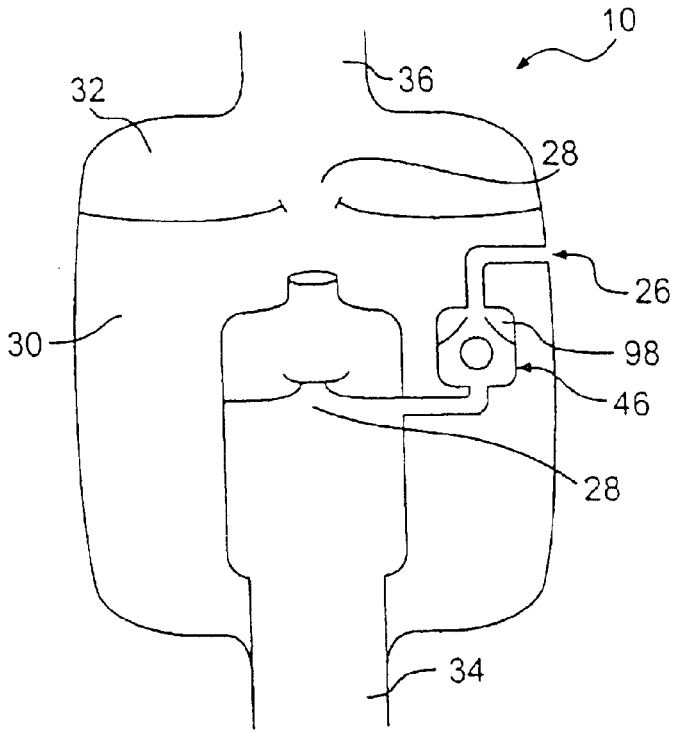
FIG. 6 is a cross-sectional view of a pressure equalization system, including a housing, several valves, and an internal subhousing with a bleed port, in accordance with another embodiment of the present invention.
Figure 7:
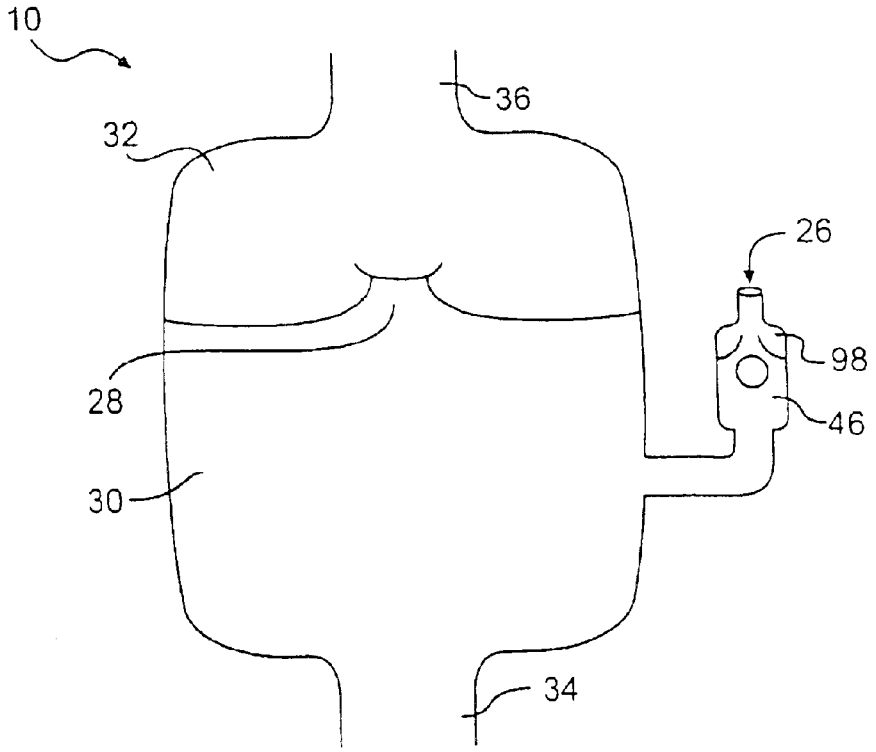
FIG. 7 is a cross-sectional view of a pressure equalization system, including a housing, two valves, and an external subhousing with a bleed port, in accordance with another embodiment of the present invention.

Additionally, as illustrated in FIGS. 4, 6, and 7, bleed port 26 may be a valve 98 of any type described above with respect to valve 28, including but not limited to magnetic check valve 48, flapper check valve 50, ball check valve 52, or a combination of any such valve and connector 42. The tolerance of valve 98 permits valve 98 to open under a lower fluid pressure, letting the fluid leak through valve 98 when compressor 2 stops operating to achieve a state of equilibrium with low pressure side 72 of compressor 2, but the tolerance permits valve 98 to close under a higher fluid pressure, preventing fluid from passing through valve 98 when compressor 2 is operating. Valve 98 therefore has a tolerance over a range of pounds per square inch that meets this requirement for the particular refrigeration or HVAC system 74. In one embodiment of the present invention, the valve in bleed port 26 can be a solenoid valve that is closed when the compressor 2 is in operation and open when the compressor 2 is not in operation.

Figure 14:
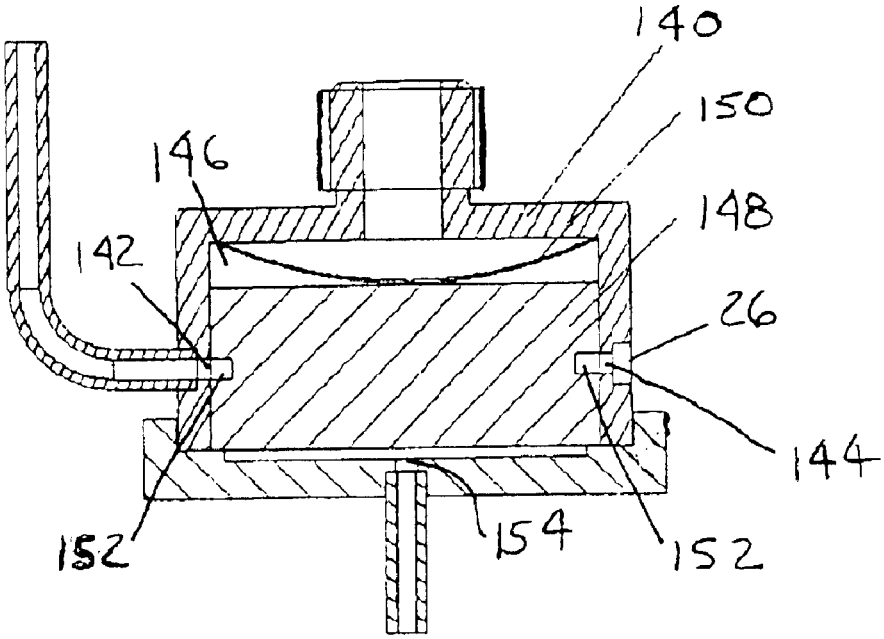
FIGS. 14 and 15 are cross-sectional views of a relief valve for a bleed port in an open position and a closed position, respectively, in one embodiment of the present invention.
Figure 15:
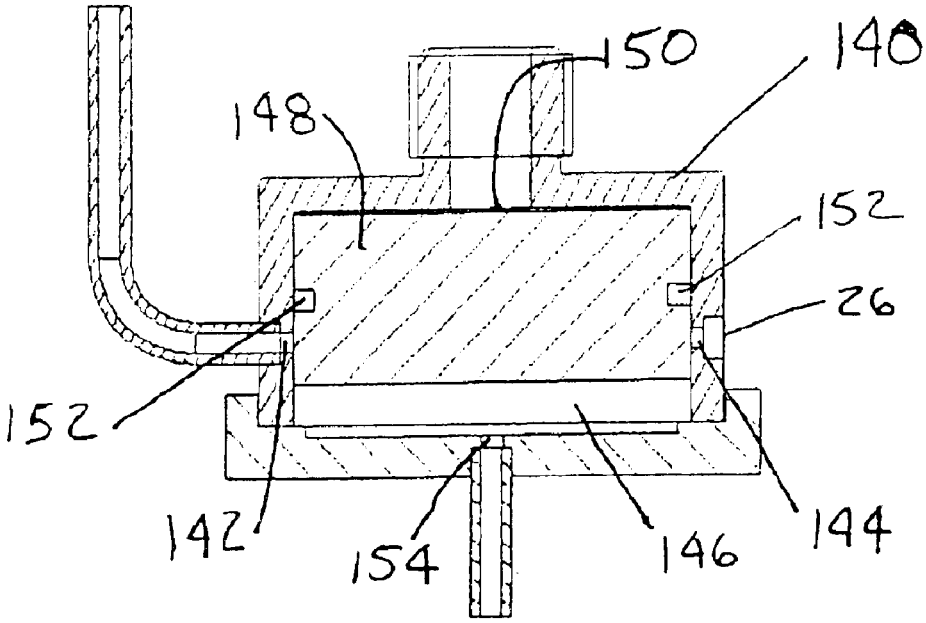

In another embodiment of the present invention, the bleed port 26 can include a relief valve 140 that can be opened and closed independently of the pressure in the first portion 30 of the housing 24. FIGS. 14 and 15 illustrate an embodiment of the present invention that includes the relief valve 140 as part of bleed port 26 that can be opened and closed independently of the pressure in the first portion 30 of the housing 24 (not shown in FIGS. 14 and 15). FIG. 14 illustrates the relief valve 140 of bleed port 26 in the open position and FIG. 15 illustrates the relief valve 140 of bleed port 26 in the closed position.

Similar to the bleed port valves described in greater detail above, the relief valve 140 is opened when the compressor 2 is not in operation to permit fluid at a high pressure vapor state in the first portion 30 of housing 24 to leak back to the low pressure side 72 of compressor 2 in order to equalize the pressures between the high pressure side 70 and the low pressure side 72 in the compressor 2. The relief valve 140 is then closed during operation of the compressor 2 to prevent or limit fluid in the first portion 30 of housing 24 from leaking back to the low pressure side 72 of compressor 2. The bleed port 26 and relief valve 140 shown in FIGS. 14 and 15 can be located either internal or external to housing 24.

Relief valve 140 has an inlet 142 in fluid communication with the first portion 30 of housing 24 and an outlet 144 in fluid communication with the bleed port 26 and the low pressure side 72 of compressor 2. Between the inlet 142 and the outlet 144 of the relief valve 140 is a chamber 146 in fluid communication with both the inlet 142 and the outlet 144. A piston 148 is slidably disposed in the chamber 146 and controls the opening and closing of the relief valve 140.

To open relief valve 140 when the compressor is not in operation, the piston 148 is urged into a first position in chamber 146 by biasing mechanism 150. Biasing mechanism 150 is disposed in contact with the piston 148 and is configured and used to urge the piston 148 to the first position in the chamber 146. The biasing mechanism 150 is preferably a spring and more preferably a leaf spring, however, any mechanism that can urge the piston 148 into the first position in the chamber 146 when the compressor 2 is not in operation can be used. In another embodiment of the present invention, instead of a mechanism to urge the piston 148 into the first position in the chamber 146, the relief valve 140 and chamber 146 can be oriented and positioned to permit gravity to move the piston 148 into the first position in the chamber 146 when the compressor 2 is not in operation.

FIG. 14 illustrates the relief valve 140 in the open position and piston 148 in the first position in the chamber 146. To permit the flow or leakage of fluid from the inlet 142 to the outlet 144, the piston 148 has a groove or channel 152 that is in fluid communication with both the inlet 142 and the outlet 144 only when the piston 148 is in the first position in the chamber 146. In a preferred embodiment of the present invention, the groove or channel 152 is disposed about the circumference or perimeter of the piston 148. However, the groove or channel 152 can also be disposed through the body of the piston 148 or disposed in any other manner that permits fluid communication between the inlet 142 and the outlet 144 only when the piston 148 is in the first position.

To close the relief valve 140 during the operation of the compressor 2, the piston 148 is urged into a second position in the chamber 146 by the operation of the compressor 2. The relief valve 140 is configured to permit an operating feature of the compressor 2 be used to apply the force that urges the piston 148 into the second position. In a preferred embodiment of the present invention, the operating feature used to urge the piston 148 into the second position is the oil pressure in the compressor 2 and more preferably the bearing oil pressure. In another embodiment, the oil pressure can be obtained from the high pressure side of the compressor 2. However, it is to be understood that any operating feature of the compressor 2 (e.g. centrifugal forces from rotating parts of the compressor 2, such as shaft 82, magnetic forces or effects from parts of the compressor 2, such as a motor stator, or flow of compressed gas) can be used to urge the piston 148 into the second position.

FIG. 15 illustrates the relief valve 140 in the closed position and piston 148 in the second position in the chamber 146. The positioning of the piston 148 in the second position in the chamber 146 prevents the flow of fluid between the inlet 142 and the outlet 144 of the relief valve 140 because the channel 152 is no longer aligned with the inlet 142 and the outlet 144 and the body of piston 148 blocks the inlet 142 and the outlet 144 preventing any fluid from flowing through the chamber 146. To urge the piston 148 into the second position, there is an opening or inlet 154 in chamber 146 that is in fluid communication with, for example, the bearing oil of the compressor 2. When the compressor 2 is operating, the pressure of the bearing oil in the compressor 2 increases, causing the bearing oil in the compressor 2 to enter the chamber 146 through opening 154 and urge the piston 148 into the second piston. The pressure of the bearing oil in the chamber 146 is sufficient to overcome the bias or tension of the biasing mechanism 150 and urge the piston into the second position. When the compressor 2 stops operating, the pressure of the oil in chamber 146 decreases as oil drains from the chamber 146 and the bias of the biasing mechanism 150 urges the piston 148 into the first position to open relief valve 140, thereby permitting the equalization of the pressure in the compressor 2.

In a preferred embodiment of pressure equalization system 10, bleed port 26 is designed so that it will permit the fluid to bleed from high pressure side 70 to low pressure side 72 only when compressor 2 is not operating. One embodiment of such a system is illustrated in FIGS. 8–10. In this embodiment, a cylinder valve 54 is formed by housing 24, poppet 58, and valve stem 60. As shown in FIGS. 8–10, depicting cylinder valve 54, valve stem 60 has an aperture 64. First portion 30 of housing 24, which is substantially solid aside from channels 56, has bleed port 26 connecting all channels 56. There may be one or more such channels 56. It is contemplated that bleed port 26 is in communication with low pressure side 72 of compressor 2, as previously discussed with respect to apertures and connectors such as tubes in embodiments shown in FIGS. 2 and 3.

In the preferred embodiment, pressure equalization system 10 is highly efficient because bleed port 26 permits equilibration of the fluid in first portion 30 of housing 24 with low pressure side 72 of compressor 2 when compressor 2 stops operating but prevents any of the fluid from leaking from first portion 30 of housing 24 when compressor 2 is operating. When compressor 2 is operating, the fluid forces poppet 58 open, which is connected to valve stem 60. Thus, aperture 64 in valve stem 60 misaligns with bleed port 26, thereby preventing any of the fluid at a high pressure vapor state from leaking from channels 56 out of bleed port 26. This "open" position is shown in FIG. 9. When compressor 2 stops operating, poppet 58 closes and aperture 64 on valve stem 60 aligns with bleed port 26, as shown in FIG. 10. Because poppet 58 closes, the fluid at a high pressure vapor state in second portion 32 of housing 24 is held at high pressure, as previously described. Meanwhile, due to the configuration of the valve stem 60, aperture 64 and bleed port 26 shown in FIG. 10, the fluid at a high pressure vapor state is permitted to leak from channels 56 in first portion 30 of housing 24, though aperture 64, into bleed port 26. Equilibration of the fluid in first portion 30 of housing 24 therefore is achieved via bleed port 26 in pressure equalization system 10, as previously described with respect to FIGS. 2 and 3.

The embodiments shown in FIGS. 1–10 are only representative of additional potential configurations of pressure equalization systems 10 and in no way are intended to limit the present invention. FIGS. 5*a* and 5*b* illustrate an embodiment of pressure equalization system 10 internal or external to compressor 2. Housing 24 contains a valve, such as a magnetic check valve 48, separating first portion 30 of housing 24 from second portion 32. First portion 30 further contains a second valve, such as a cylinder-type check valve 54, operably disposed in a check valve guide 68. Cylinder check valve guide 68 defines low pressure chambers 76 on either side. Cylinder check valve 54 has a lip 66 on the end facing inlet 34 of housing 24 to prevent cylinder check valve 54 from passing through check valve guide 68 when compressor 2 is operating. Cylinder check valve 54 also has a channel 56 through which the fluid passes towards outlet 36 of housing 24 when compressor 2 is operating. Bleed port 26 is an aperture located in housing 24 in an area encompassed by low pressure chamber 76. Pressure equalization system 10, as shown in FIGS. 5*a* and 5*b*, therefore maintains the fluid at a high pressure vapor state in second portion 32 of housing 24 while permitting the fluid in first portion 30 of housing 24 to equilibrate with the fluid at a low pressure vapor state.

Figure 5A:
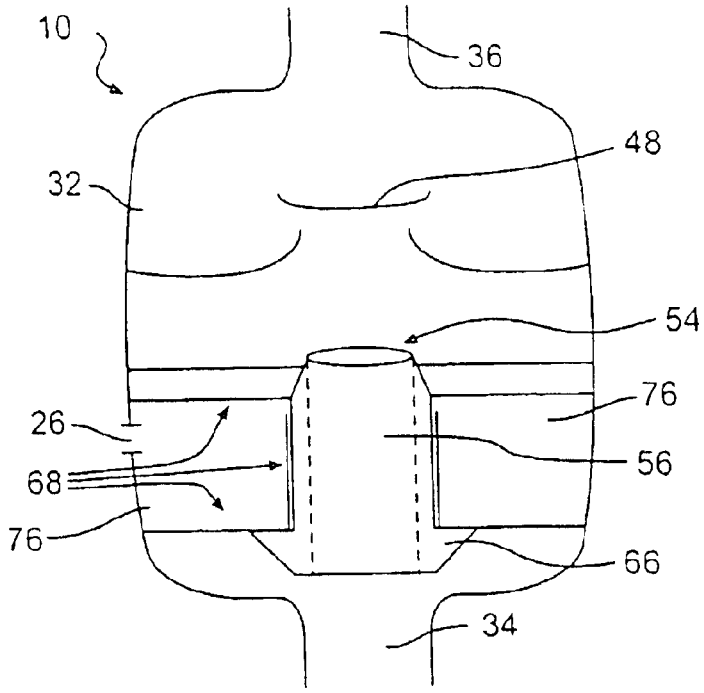
FIGS. 5*a* and 5*b* are cross-sectional views of a pressure equalization system, including a housing, two valves, and a bleed port in a closed position and an open position, respectively, in one embodiment of the present invention.
Figure 5B:
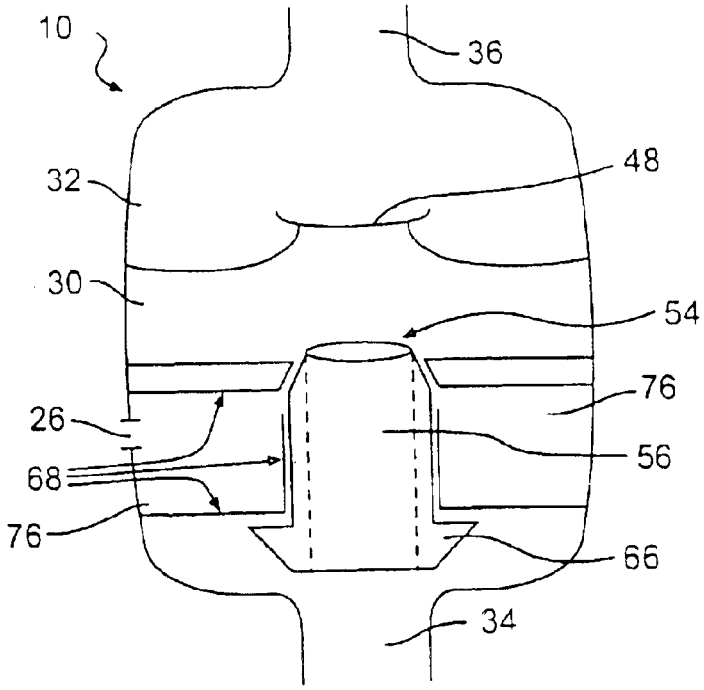

As shown in FIG. 5*a*, when compressor 2 is operating, the fluid flows at a high pressure state into first portion 30 of housing 24, through first channel 56 of cylinder check valve 54, and through magnetic check valve 48 into second portion 32 of housing 24. Because of the fluid pressure, cylinder check valve 54 abuts cylinder check valve guide 68, closing bleed port 26. When compressor 2 stops operating, as shown in FIG, 5*b*, magnetic check valve 48 closes and the fluid remains at a high pressure vapor state in second portion 32 of housing 24. The fluid in first portion 30 of housing 24 is also at a high pressure vapor state but begins to leak into low pressure chambers 76 and through bleed port 26. When compressor 2 stops operating, the fluid pressure against the bottom of cylinder check valve 54 decreases and cylinder check valve 54 no longer abuts against the cylinder check valve guide 68.

FIGS. 6 and 7 illustrate embodiments of the present invention where bleed port 26 is a subhousing 46 housing a valve 98. In FIG. 6, subhousing 46 for valve 98 is located internally within first portion 30 of housing 24, while in FIG. 7 subhousing 46 for valve 98 is external to, but in communication with, first portion 30 of housing 24. The pressure equalization systems depicted in FIGS. 6 and 7 generally operate in the same manner as those previously described.

Figure 16:
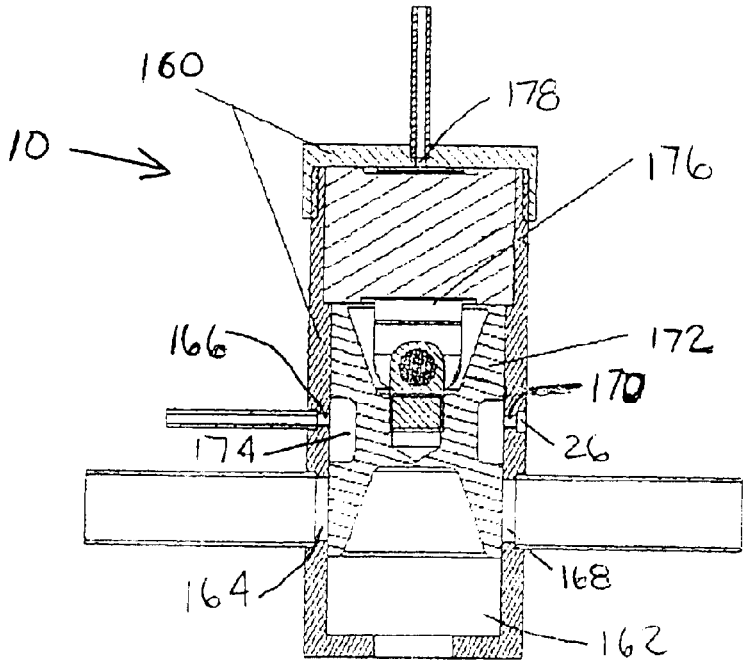
FIGS. 16 and 17 illustrate an alternate embodiment of the pressure equalization system of the present invention.
Figure 17:
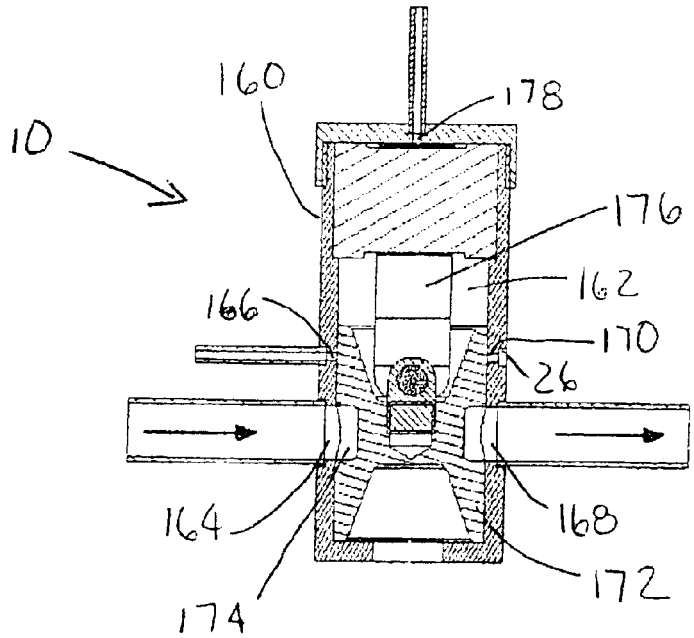

FIGS. 16 and 17 illustrate an alternate embodiment of the pressure equalization system 10, which uses a single device to control both discharge flow of high pressure fluid from the compressor 2, when the compressor 2 is in operation, and relief flow of high pressure fluid to equalize the pressure in the compressor 2, when the compressor 2 is not in operation. FIG. 16 illustrates the pressure equalization system 10 when the compressor 2 is not in operation and FIG. 17 illustrates the pressure equalization system 10 when the compressor 2 is in operation.

The pressure equalization system 10 includes a housing 160 having an internal chamber 162. The housing 160 has an inlet or opening 164 for discharge flow of high pressure fluid into the chamber 162 and an inlet or opening 166 for relief flow of high pressure fluid into the chamber 162. The discharge inlet 164 and the relief inlet 166 are in fluid communication with the compressor 2 to receive high pressure fluid from the compressor 2. The high pressure fluid entering the discharge inlet 164 and the relief inlet 166 can flow directly from the outlet 20 of the compressor 2 or the cylinder head of the compressor 2 in a direct piping connection or the high pressure fluid can enter the discharge inlet 164 and the relief inlet 166 after flowing through one or more intermediate chambers or containers, e.g. first portion 30 of housing 24. The housing 160 also includes a discharge outlet 168 and a relief outlet 170 for the exiting of high pressure fluid from the chamber 162. The discharge outlet 168 is in fluid communication with the condenser 8 permitting the high pressure fluid to flow to the condenser 8 as described above. The relief outlet 170 is in fluid communication with bleed port 26 permitting the high pressure fluid to return the low pressure side 72 of compressor 2 to equalize pressure in the compressor 2 when the compressor 2 is not in operation.

A piston 172 is slidably disposed within chamber 162 and operates as a discharge valve between discharge inlet 164 and discharge outlet 168 and as a relief valve between relief inlet 166 and relief outlet 170. When the compressor 2 is in operation, the piston 172 is positioned in a first position, as shown in FIG. 17, which results in the discharge valve being open to permit high pressure fluid to flow to the condenser 8 and results in the relief valve being closed to prevent flow of high pressure fluid back to the low pressure side 72 of compressor 2. Similarly, when the compressor 2 is not in operation, the piston 172 is positioned in a second position, as shown in FIG. 16, which results in the relief valve being open to permit flow of high pressure fluid back to the low pressure side 72 of compressor 2 and results in the discharge valve being closed preventing the high pressure fluid on the high pressure side 70 of the compressor 2 from equalizing with low pressure fluid on the low pressure side of the compressor 2.

For the opening of the discharge valve or the relief valve, the piston 172 has a groove or channel 174. To open the discharge valve, the groove 174 is in fluid communication with both the discharge inlet 164 and the discharge outlet 168 only when the piston 172 is in the first position in the chamber 162. The body of the piston 172 is then used to block the relief inlet 166 and relief outlet 170 when the piston 172 is in the first position in the chamber 162, thereby closing the relief valve. To open the relief valve, the groove 174 is in fluid communication with both the relief inlet 166 and the relief outlet 170 only when the piston 172 is in the second position in the chamber 162. The body of the piston 172 is then used to block the discharge inlet 164 and discharge outlet 168 when the piston 172 is in the second position in the chamber 162, thereby closing the discharge valve. In a preferred embodiment of the present invention, the groove or channel 174 is disposed about the circumference or perimeter of the piston 172. However, the groove or channel 174 can also be disposed through the body of the piston 172 or disposed in any other manner that permits fluid communication between the discharge inlet 164 and the discharge outlet 168 or the relief inlet 166 and relief outlet 170 depending on the position of the piston 172 in the chamber 162.

The pressure equalization system 10 shown in FIGS. 16 and 17 is configured to permit the use of an operating feature of the compressor 2 to apply a force to the piston 172 that urges the piston 172 into the first position. In a preferred embodiment of the present invention, the operating feature used to urge the piston 172 into the first position is the oil pressure in the compressor 2 and more preferably the bearing oil pressure. In another embodiment, the oil pressure can be obtained from the high pressure side of the compressor 2. However, it is to be understood that any operating feature of the compressor 2 (e.g. centrifugal forces or torque from rotating parts of the compressor 2, such as shaft 82, magnetic forces or effects, preferably from parts of the compressor 2 such as a motor stator, or flow of compressed gas) can be used to urge the piston 172 into the first position.

The pressure equalization system 10 further uses a biasing mechanism 176 to position the piston 172 in the second position when the compressor is not in operation. The biasing mechanism 176 is operatively connected to the piston 172 to position the piston 172 into the second position. The biasing mechanism 176 can be configured to pull the piston 172 into the second position as shown in FIGS. 16 and 17, or can be configured to urge or push the piston 172 into the second position in a manner similar to that shown in FIGS. 14 and 15. The biasing mechanism 176 is preferably a spring, and for the embodiment shown in FIGS. 16 and 17 the biasing mechanism is more preferably an extension spring, however, any mechanism that can position the piston 172 into the second position in the chamber 162 when the compressor 2 is not in operation can be used.

In the preferred embodiment of the biasing mechanism 176 using the extension spring, the extension spring is connected to the piston 172 using a bolt, rivet or other similar connection. Additionally, the biasing mechanism 176 can have a spring holder disposed in the chamber 162 to hold the extension spring, while still permitting the operational feature of the compressor 2 to urge the piston 176 into the first position.

To urge the piston 172 into the first position in the chamber 162, there is an opening or inlet 178 in chamber 162 that is in fluid communication with the bearing oil of the compressor 2. When the compressor 2 is operating, the pressure of the bearing oil in the compressor 2 increases, causing the bearing oil in the compressor 2 to enter the chamber 162 through opening 178 and urge the piston 172 into the first position. The pressure of the bearing oil in the chamber 162 is sufficient to overcome any bias or tension of the biasing mechanism 176 and urge the piston 172 into the first position. When the compressor 2 stops operating, the pressure of the oil in chamber 162 decreases as oil drains from the chamber 162 and the bias of the biasing mechanism 176 positions the piston 172 into the second position to open the relief valve, thereby permitting the equalization of the pressure in the compressor 2.

The method for equalizing pressure to permit compressor 2 to start under non-high pressure loading using pressure equalization system 10 will now be described in detail with reference to FIG. 3. When compressor 2 is turned on, the fluid enters compressor 2 at a low pressure vapor state through compressor inlet 16 and into compression chamber 80. As piston 78 compresses the fluid, valve system 84 prevents the fluid from exiting compressor 2 through inlet 16, as previously described. Valve 92 opens under the increasing pressure, permitting the fluid, now at a high pressure vapor state, to discharge through compressor outlet 20 and into inlet 34 of housing 24. The fluid then passes from first portion 30 of housing 24 and through valve 28 into second portion 32 of housing 24. Valve 28 opens due to the pressurized flow of the fluid created by piston 78. The fluid then exits housing 24 through housing outlet 36 on its way to condenser 8, as shown schematically in FIG. 1.

When compressor 2 is turned off, valves 28 and 92 close as piston 78 no longer is compressing and forcing the fluid through compressor outlet 20. Due to the lower fluid pressure, expansion valve 6 also closes. The fluid located downstream from valve 28 in second portion 32 of housing 24 therefore remains at a high pressure vapor state and maintains the high pressure side 70, as shown in FIG. 1. Meanwhile, the fluid at a high pressure vapor state located in first portion 30 of housing 24 bleeds through bleed port 26 back toward compressor inlet 16 and equalizes with the fluid at a low pressure vapor state in compressor inlet 16.

Upon restarting compressor 2, high pressure side 70, as shown in FIG. 1, has remained high due to the high pressure state of the fluid downstream from valve 28. Meanwhile, the fluid upstream from valve 28 is at a lower pressure state following the equilization process. As a result, when piston 78 begins to compress the fluid upon restarting compressor 2, the fluid upstream from valve 28 is at a lower pressure, making it easier for piston 78 to perform compression. At the same time, a high pressure state has been maintained downstream from valve 28, thus the compression cycle is not starting with equalized pressures in the refrigeration system 74 and less work is required to achieve the pressures in the refrigeration system 74 just prior to when the compressor 2 stopped operating. Thus the pressure equalization method and system increases the efficiency of the compressor 2 and the climate control system of which it is a component.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system to equalize fluid pressure in a compressor having a first portion at a first pressure and a second portion at a second pressure greater than the first pressure, the system comprising:

a housing, the housing comprising:

a first inlet for a fluid, the first inlet for the fluid being in fluid communication with the second portion of the compressor;

a second inlet for the fluid, the second inlet for the fluid being in fluid communication with the second portion of a compressor;

a first outlet for the fluid, the first outlet for the fluid being configured to permit flow of the fluid from the system; and a second outlet for the fluid, the second outlet for the fluid being in fluid communication with the first portion of the compressor;

a chamber disposed within the housing, the chamber being in fluid communication with the first inlet, the second inlet, the first outlet and the second outlet;

a piston slidably disposed within the chamber between a first position and a second position, wherein the first inlet and the first outlet are in fluid communication upon the piston being in the first position and the second inlet and the second outlet are in fluid communication upon the piston being in the second position;

means for moving the piston in the chamber between the first position and the second position; and wherein the means for moving the piston in the chamber positions the piston in the second position in response to the compressor not being in operation, thereby permitting the fluid at the second pressure to flow through the second outlet to the first portion of the compressor to equalize pressure in the compressor.

2. The system of claim 1 wherein the piston includes a channel, the channel being configured to provide a passage for the fluid between the first inlet and the first outlet upon the piston being in the first position and to provide a passage for the fluid between the second inlet and the second outlet upon the piston being in the second position.

3. The system of claim 2 wherein the channel is disposed around a perimeter of the piston.

4. The system of claim 2 wherein the channel is disposed through the piston.

5. The system of claim 1 wherein the means for moving the piston further comprises:

means for urging the piston into the first position using an operating feature of a compressor; and means for positioning the piston into the second position from the first position.

6. The system of claim 5 wherein the means for urging the piston into the first position comprises means for urging the piston into the first position using oil from the compressor.

7. The system of claim 6 wherein the means for urging the piston into the first position using oil from the compressor comprises an oil inlet, the oil inlet being disposed in the housing and being in fluid communication with the chamber.

8. The system of claim 7 wherein oil from the compressor flows through the oil inlet and urges the piston into the first position upon the compressor being in operation.

9. The system of claim 5 wherein the means for urging the piston into the first position comprises means for urging the piston into the first position using torque from the compressor.

10. The system of claim 5 wherein the means for urging the piston into the first position comprises means for urging the piston into the first position using magnetic forces.

11. The system of claim 5 wherein the means for positioning the piston into the second position comprises a spring.

12. The system of claim 11 wherein the spring comprises an extension spring.

13. The system of claim 1 wherein the piston is configured to prevent the fluid from passing through the second inlet and the second outlet upon the piston being in the first position and to prevent the fluid from passing through the first inlet and the first outlet upon the piston being in the second position.

14. The system of claim 5 wherein the means for urging the piston into the first position comprises means for urging the piston into the first position using a flow of compressed gas.

15. A system to equalize pressure in a compressor having a first portion at a first pressure and a second portion at a second pressure greater than the first pressure, the system comprising:

a housing, the housing comprising:

at least one inlet for a fluid the at least one inlet for the fluid being in fluid communication with the second portion of the compressor;

a first outlet for the fluid, the first outlet for the fluid being configured to permit flow of the fluid from the system; and a second outlet for the fluid, the second outlet for the fluid being in fluid communication with the first portion of the compressor;

a chamber disposed within the housing, the chamber being in fluid communication with the at least one inlet, the first outlet and the second outlet;

means for providing a fluid passageway from the at least one inlet to the first outlet upon the compressor being in operation to permit flow of the fluid from the system; and means for providing a fluid passageway from the at least one inlet to the second outlet upon the compressor not being in operation to permit a fluid at the second pressure to flow through the second outlet to the first portion of the compressor to equalize pressure in the compressor.

16. The system of claim 15 wherein the means for providing a fluid passageway from the at least one inlet to the first outlet upon the compressor being in operation further comprises:

a piston slidably disposed within the chamber; end means for sliding the piston in the chamber.

17. The system of claim 16 wherein the piston is configured and disposed to prevent the fluid from entering the second outlet upon the compressor being in operation.

18. The system of claim 16 wherein the means for providing a fluid passageway from the at least one inlet to the second outlet upon the compressor not being in operation further comprises the piston slidably disposed within the chamber.

19. The system of claim 18 wherein the piston is configured and disposed to prevent the fluid from entering the first outlet upon the compressor not being in operation.

20. The system of claim 18 wherein:

the at least one inlet comprises a first inlet in fluid communication with the second portion of the compressor and a second inlet in fluid communication with the second portion of the compressor; and the piston includes a channel, the channel being configured to provide a first passage for fluid between the first inlet and the first outlet upon the compressor being in operation and to provide a second passage for fluid between the second inlet and the second outlet upon the compressor not being in operation.

21. The system of claim 20 wherein the channel is disposed around a perimeter of the piston.

22. The system of claim 20 wherein the channel is disposed through the piston.

23. The system of claim 18 wherein the means for sliding the piston in the chamber slides the piston between a first position and a second position, wherein the at least one inlet and the first outlet are in fluid communication upon the piston being in the first position and the at least one inlet and the second outlet are in fluid communication upon the piston being in the second position.

24. The system of claim 23 wherein the means for sliding the piston further comprises:

means for urging the piston into the first position using an operating feature of the compressor; and means for positioning the piston into the second position from the first position.

25. The system of claim 24 wherein the means for urging the piston into the first position comprises means for urging the piston into the first position using oil from the second portion of the compressor.

26. The system of claim 25 wherein the means for urging the piston into the first position using oil from the second portion of the compressor comprises an oil inlet, the oil inlet being disposed in the housing and being in fluid communication with the chamber.

27. The system of claim 26 wherein oil from a compressor flows through the oil inlet and urges the piston into the first position upon the compressor being in operation.

28. The system of claim 24 wherein the means for urging the piston into the first position comprises means for urging the piston into the first position using torque from the compressor.

29. The system of claim 24 wherein the means for urging the piston into the first position comprises means for urging the piston into the first position using magnetic forces from the compressor.

30. The system of claim 24 wherein the means for sliding the piston further comprises a biasing mechanism to position the piston into the second position.

31. The system of claim 30 wherein the biasing mechanism comprises an extension spring.

32. The system of claim 24 wherein the means for urging the piston into the first position comprises means for urging the piston into the first position using a flow of compressed gas.

33. A system to equalize pressure between a first portion of a compressor at a first pressure and a second portion of a compressor at a second pressure greater than the first pressure, the system comprising:

a valve, the valve being in fluid connection with the second portion of the compressor, the valve having an open position permitting flow of fluid from the system upon the compressor being in operation and a closed position preventing flow of the fluid through the valve upon the compressor not being in operation; and a bleed port upstream of the valve and in fluid communication with the second portion of the compressor, the bleed port comprising a relief valve controlled by an operational feature of the compressor, the relief valve being in an open position upon the compressor not being in operation to permit flow of fluid through the bleed port to the first portion of the compressor to equalize pressure in the compressor, and the relief valve being in a closed position upon the compressor being in operation to prevent flow of the fluid through the bleed port to the first portion of the compressor.

34. The system of claim 33 wherein the relief valve further includes:

a piston slidable between a first position and a second position, wherein the relief valve is in the open position upon the piston being in the first position and the relief valve is in the closed position upon the piston being in the second position; and means for sliding the piston between the first position and the second position.

35. The system of claim 34 wherein the piston includes a channel, the channel being configured to provide a first passage for the fluid to open the relief valve upon the piston being in the first position and to block a second passage for fluid to close the relief valve upon the piston being in the second position.

36. The system of claim 33 wherein the channel is disposed around a perimeter of the piston.

37. The system of claim 35 wherein the channel is disposed through the piston.

38. The system of claim 34 wherein the means for sliding the piston further comprises:

means for urging the piston into the first position using an operating feature of the compressor; and means for positioning the piston into the second position from the first position.

39. The system of claim 38 wherein the means for urging the piston into the first position comprises means for urging the piston into the first position using oil from the compressor.

40. The system of claim 39 wherein the means for urging the piston into the first position using oil from the compressor comprises an oil inlet, the oil inlet being disposed in the relief valve and being in fluid communication with the piston.

41. The system of claim 40 wherein oil from the compressor flows through the oil inlet and urges the piston into the first position upon the compressor being in operation.

42. The system of claim 38 wherein the means for urging the piston into the first position comprises means for urging the piston into the first position using torque from the compressor.

43. The system of claim 38 wherein the means for urging the piston into the first position comprises means for urging the piston into the first position using magnetic forces.

44. The system of claim 38 wherein the means for positioning the piston into the second position comprises a biasing mechanism.

45. The system of claim 38 wherein the biasing mechanism comprises a leaf spring.

46. The system of claim 44 wherein the means for urging the piston into the first position comprises means for urging the piston into the first position using a flow of compressed gas.

47. A system to equalize pressure between a first portion of a compressor at a first pressure and a second portion of a compressor at a second pressure greater than the first pressure, the system comprising:

a container having a first section and a second section, the first section of the container being in fluid communication with the second portion of the compressor and the second section of the container having an outlet for fluid from the system;

a valve, the valve being disposed in the container between the first section of the container and the second section of the container, the valve having an open position permitting flow of fluid from the first section of the container to the second section of the container upon the compressor being in operation and a closed position preventing flow of fluid from the first section of the container to the second section of the container upon the compressor not being in operation;

a relief valve in fluid communication with the first section of the container, the relief valve being controlled by an operational feature of a compressor, the relief valve having an open position upon the compressor not being in operation to permit flow of fluid through the relief valve and a closed position to prevent flow of fluid through the relief valve upon the compressor being in operation; and a bleed port in fluid communication with the relief valve and the first portion of the compressor, the bleed port being configured and disposed to permit flow of fluid from the relief valve to the first portion of the compressor upon the relief valve being in the open position in response to the compressor not being in operation to equalize pressure in the compressor.

48. The system of claim 47 wherein the relief valve further comprises:

an inlet in fluid communication with the first section of the container and an outlet in fluid communication with the bleed port, the open position of the relief being configured to provide a fluid path between the inlet of the relief valve and the outlet of the relief valve and the closed position of the relief valve being configured to prevent fluid flow between the inlet of the relief valve and the outlet of the relief valve;

a piston slidable between a first position and a second position, wherein the relief valve is in the open position upon the piston being in the first position and the relief valve is in the closed position upon the piston being in the second position; and means for sliding the piston between the first position and the second position.

49. The system of claim 48 wherein the piston includes a channel, the channel being configured to provide a passage for fluid between the inlet of the relief valve and the outlet of the relief valve upon the piston being in the first position and to prevent flow of the fluid between the inlet of the relief valve and the outlet of the relief valve upon the piston being in the second position.

50. The system of claim 49 wherein the channel is disposed around a perimeter of the piston.

51. The system of claim 49 wherein the channel is disposed through the piston.

52. The system of claim 48 wherein the means for sliding the piston further comprises:

means for urging the piston into the first position using an operating feature of the compressor; and means for positioning the piston into the second position from the first position.

53. The system of claim 52 wherein the means for urging the piston into the first position comprises means for urging the piston into the first position using oil from a compressor.

54. The system of claim 53 wherein the means for urging the piston into the first position using oil from the compressor comprises an oil inlet, the oil inlet being disposed in the relief valve and being in fluid communication with the piston.

55. The system of claim 54 wherein oil from the compressor flows through the oil inlet and urges the piston into the first position upon the compressor being in operation.

56. The system of claim 52 wherein the means for urging the piston into the first position comprises means for urging the piston into the first position using torque from the compressor.

57. The system of claim 52 wherein the means for urging the piston into the first position comprises means for urging the piston into the first position using magnetic forces from the compressor.

58. The system of claim 52 wherein the means for positioning the piston into the second position comprises a leaf spring.

59. The system of claim 55 wherein the means for urging the piston into the first position comprises means for urging the piston into the first position using a flow of compressed gas.

60. The system of claim 47 wherein the container is disposed internal to the compressor.

61. The system of claim 47 wherein the container is disposed external to the compressor.

62. The system of claim 47 wherein the relief valve is disposed internal to the first section of the container.

63. The system of claim 47 wherein the relief valve is disposed external to the first section of the container.

64. A climate control system having a high pressure side and a low pressure side, wherein a fluid flowing through the climate control system changes state between a vapor state and a liquid state to provide climate control, the climate control system comprising:

a compressor being operable to compress a fluid at a low pressure to a high pressure, the compressor comprising an inlet portion to receive fluid at a low pressure from the low pressure side of the system and an outlet portion to provide fluid at a high pressure to the high pressure side of the system; and a pressure equalization system operatively connected to the compressor, the pressure equalization system being configured to equalize pressure between the inlet portion and the outlet portion of the compressor in response to the compressor not being in operation, the pressure equalization system comprising:

a first inlet for fluid, the first inlet for fluid being in fluid communication with the outlet portion of the compressor;

a second inlet for fluid, the second inlet for fluid being in fluid communication with the outlet portion of the compressor;

a first outlet for fluid, the first outlet for fluid being in fluid communication with the high pressure side of the system;

a second outlet for fluid, the second outlet for fluid being in fluid communication with the inlet portion of the compressor;

a chamber configured and disposed to provide a path for fluid between the first inlet and the second inlet and the first outlet and the second outlet;

a piston slidably disposed within the chamber between a first position and a second position, wherein the first inlet and the first outlet are in fluid communication upon the piston being in the first position and the second inlet and the second outlet are in fluid communication upon the piston being in the second position;

means for moving the piston in the chamber between the first position and the second position; and wherein the means for moving the piston in the chamber positions the piston in the second position in response to the compressor not being in operation, thereby permitting fluid at a high pressure to flow through the second outlet to the first inlet portion of the compressor to equalize pressure in the compressor.

65. A system to equalize pressure between a first portion of a compressor at a first pressure and a second portion of a compressor at a second pressure greater than the first pressure, the system comprising:

a container having a first section and a second section, the first section of the container being in fluid communication with the second portion of the compressor and the second section of the container having an outlet for fluid from the system;

a first valve, the first valve being disposed in the container between the first section of the container and the second section of the container, the first valve having an open position permitting flow of fluid from the first section of the container to the second section of the container upon the compressor being in operation and a closed position preventing flow of fluid from the first section of the container to the second section of the container upon the compressor not being in operation;

a second valve in fluid communication with the first section of the container, the second valve having an open position upon the compressor not being in operation to permit flow of fluid through the second valve and a closed position to prevent flow of fluid through the second valve upon the compressor being in operation; and a bleed port in fluid communication with the second valve and the first portion of the compressor, the bleed port being configured and disposed to permit flow of fluid from the second valve to the first portion of the compressor upon the second valve being in the open position to equalize pressure in the compressor in response to the compressor not being in operation.

66. The system of claim 65 wherein the second valve is a relief valve controlled by an operational feature of a compressor.

67. The system of claim 65 wherein the second valve is a solenoid valve.

68. The system of claim 65 wherein the second valve is a check valve.

69. The system of claim 68 wherein the check valve comprises one of a magnetic check valve, a flapper check valve, a ball check valve and a cylinder check valve.

70. The system of claim 65 wherein the second valve is disposed within the container.

71. The system of claim 65 wherein the second valve is disposed external to the container.

72. The system of claim 65 wherein the compressor has a housing and the container is disposed within the housing of the compressor.

* * * * *

UNITED STATES PATENT AND TRADEMARK OFFICE

CERTIFICATE OF CORRECTION

PATENT NO. : 6,823,686 B2
DATED : November 30, 2004
INVENTOR(S) : Chumley et al.

It is certified that error appears in the above-identified patent and that said Letters Patent is hereby corrected as shown below:

Column 10,
Line 56, "second piston" should be -- second position --.

Column 11,
Line 42, before "FIGS. 5a" start a new paragraph.

Column 16,
Line 28, "fluid the" should be -- fluid, the --.

Column 18,
Line 25, "claim 33" should be -- claim 35 --.
Line 55, "claim 38" should be -- claim 44 --.
Line 57, "claim 44" should be -- claim 38 --.

Signed and Sealed this

Twenty-first Day of February, 2006

JON W. DUDAS
*Director of the United States Patent and Trademark Office*